United States Patent [19]

Reba

[11] 4,453,709

[45] Jun. 12, 1984

[54] SYSTEM FOR SERIALLY CONVEYING DISCRETE FLEXIBLE ARTICLES

[75] Inventor: Imants Reba, Vancouver, Wash.

[73] Assignee: Crown Zellerbach Corporation, San Francisco, Calif.

[21] Appl. No.: 375,793

[22] Filed: May 7, 1982

[51] Int. Cl.[3] ..... B65H 29/24

[52] U.S. Cl. ..... 271/195; 226/7; 226/97; 271/186; 271/207

[58] Field of Search ..... 271/195, 97, 98, 186, 271/207; 226/7, 97

[56] References Cited

U.S. PATENT DOCUMENTS

| | | | |
|---|---|---|---|
| 3,550,964 | 12/1970 | Spyropoulos | 271/195 X |
| 3,633,281 | 1/1972 | Vits | 271/195 X |
| 3,918,706 | 11/1975 | Craft | 271/195 X |
| 4,053,967 | 10/1977 | Mair | 226/97 X |
| 4,186,860 | 2/1980 | Reba | 226/97 X |

*Primary Examiner*—Richard A. Schacher

*Attorney, Agent, or Firm*—Thomas R. Lampe

[57] ABSTRACT

A system for serially conveying discrete flexible articles including a plurality of sequentially activated Coanda nozzles disposed along an article flow path and article support means cooperable with the nozzles to propel and stabilize the articles.

15 Claims, 10 Drawing Figures

SYSTEM FOR SERIALLY CONVEYING DISCRETE FLEXIBLE ARTICLES

BACKGROUND OF INVENTION

1. Field of Invention

This invention relates to an apparatus and method for serially conveying discrete flexible articles such as plastic bags between a first station and a second station and incorporating means for stabilizing the articles during conveyance thereof.

2. Description of the Prior Art

The present invention has application to any operating environment wherein it is desired to serially convey discrete flexible articles while at the same time maintaining stability of the articles to ensure their accurate positioning at the end of the conveying operation. The invention has particular application to commercial plastic bread bag machines wherein the highly flexible and thin bags must be conveyed under high speeds to a stacking station whereat the bags must be in precise registry with the stacking mechanism. Rope or belt conveyors have conventionally been used in the plastic bag industry to assist in transporting the bags to a stacking station. Such mechanical conveyors, however, have had a number of drawbacks. Not only are such mechanical arrangements subject to wear, they are also very limited as to performance. If operated at high production rates the rope or belt conveyors often cannot maintain the accuracy of placement required by the stacking mechanism. The rope or belt conveyors conventionally merely provide support surfaces for the bags or other flexible articles being conveyed and such moving articles tend to float over the surfaces and curl at the leading edges thereof. Air jets have been employed in an attempt to maintain the articles flattened in position on the support surfaces but these arrangements have proven to be unsatisfactory, in many cases actually exacerbating the conditions of turbulence which distort the articles and prevent proper registration with the stacking mechanism. Plastic bread bags and similar articles conventionally have apertures found at one end thereof to permit stacking over wickets. The article ends must be in precise registry with the stacking mechanism that accomplishes this. Prior art rope mechanisms often result in distortion at the article ends, additionally contributing to poor stacking and consequent production losses.

The present invention employs a gaseous flow to convey the bag or other flexible article to a predetermined station such as a pick-up or stacking station. While air tables and similar arrangements are known and widely used in the conveying art, such prior art devices are incapable of transporting plastic bread bags or other similar thin discrete articles at high speeds and under conditions ensuring nondistortion of the bags during transport and their accurate placement at the end of the conveying operation. Representative prior art patents are U.S. Pat. Nos. 2,805,898, 3,198,515, 3,633,281, 3,650,043, 3,705,676, 3,721,472, 3,773,391, 3,999,696, 4,014,487, 4,081,201, 4,087,133, 4,136,808 and 4,186,860. By means of air flows the present invention not only imparts propelling forces to the article but also imparts downward and endwise suction forces to straighten the article and maintain it in a generally flat condition.

BRIEF SUMMARY OF THE INVENTION

According to the teachings of a preferred embodiment of the present invention, a plurality of Coanda nozzles are positioned along a flow path between a source of discrete flexible articles and a downstream station. Article support means is disposed between the Coanda nozzles defining spaced generally flat support surfaces and a plurality of apertures between these surfaces and in communication therewith. The nozzles and the article support means cooperate to separate gaseous flow induced by at least one of the nozzles into a laminar fluid flow component directed along the support surfaces toward the downstream station to propel the articles and exert a downward pull thereon and a vented more turbulent fluid flow component directed through the apertures. The venting reduces the thickness of the gaseous flow over the support surfaces to reduce air disturbances that would otherwise be imparted to the articles during conveyance thereof. Further stability is imparted to the conveyed articles by auxilliary fluid flow generating means exerting pulling forces on the articles during conveyance thereof in generally opposed directions laterally disposed relative to the flow path. The system incorporates an adjustment mechanism to accommodate articles of different sizes.

DETAILED DESCRIPTION

Figure 2:
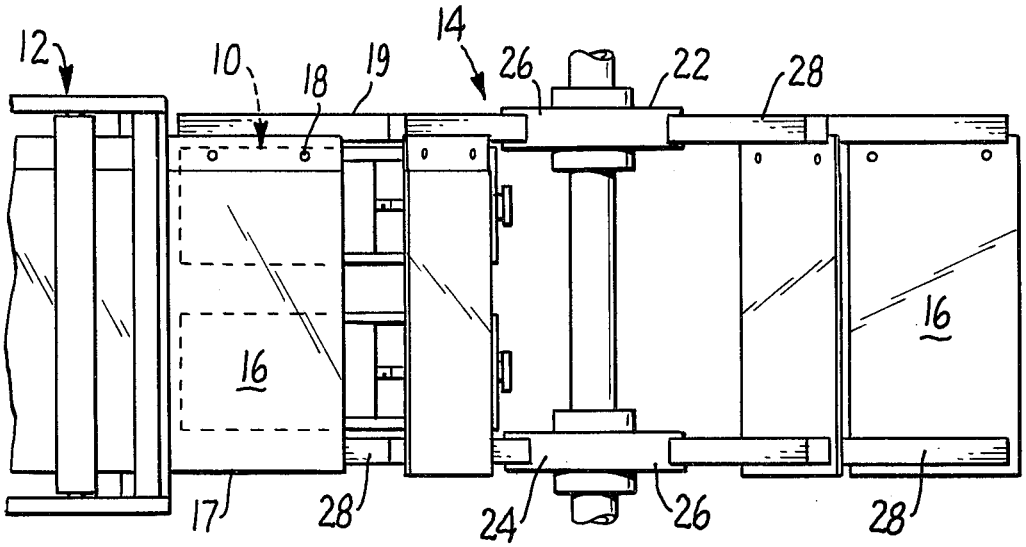
FIG. 2 is a plan view showing the mechanism of FIG. 1.
Figure 1:
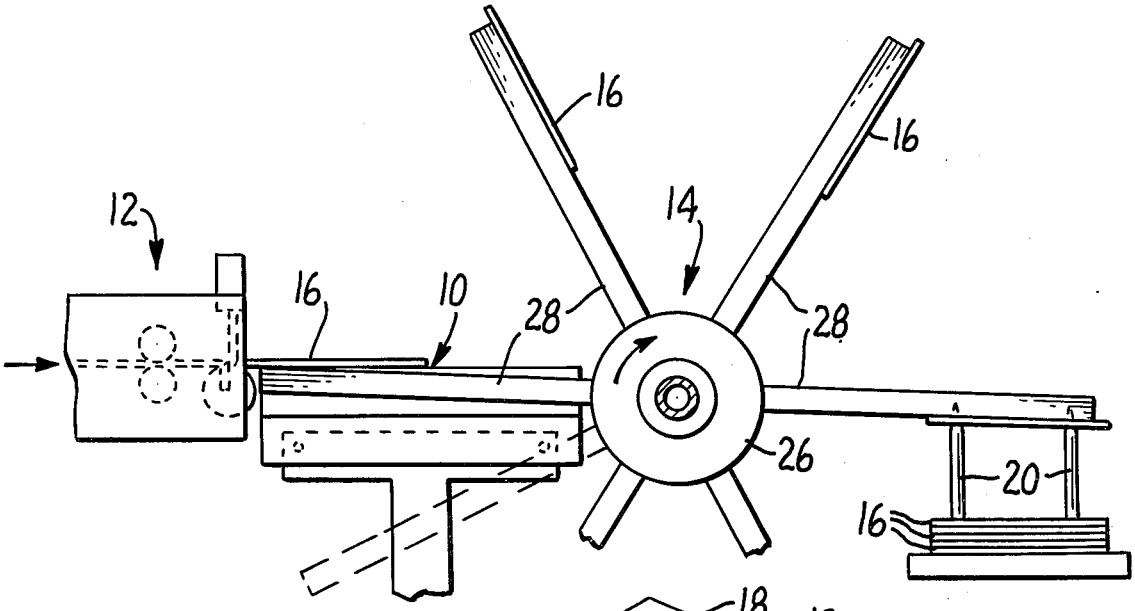
FIG. 1 is a schematic side view of apparatus constructed in accordance with the teachings of the present invention disposed between a source of plastic bags and a stacking mechanism for the bags.
Figure 3:
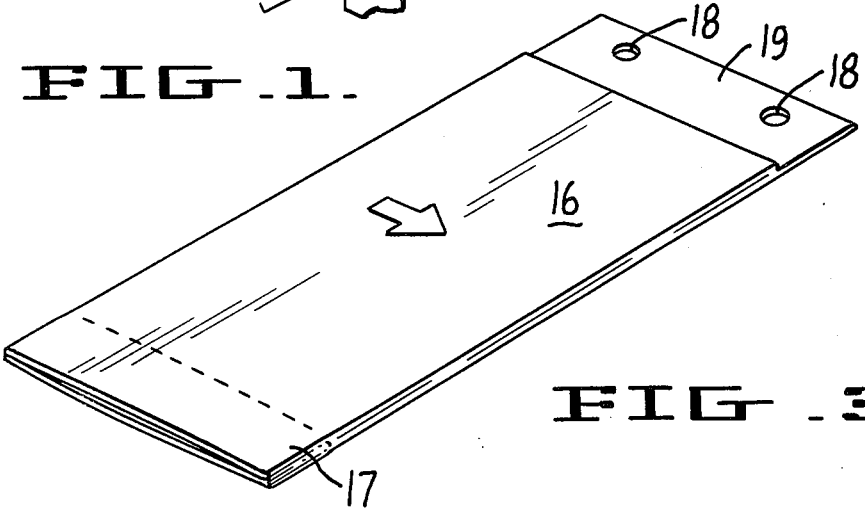
FIG. 3 is a perspective view of a representative form of flexible plastic bag to be conveyed by the apparatus.
Figure 4:
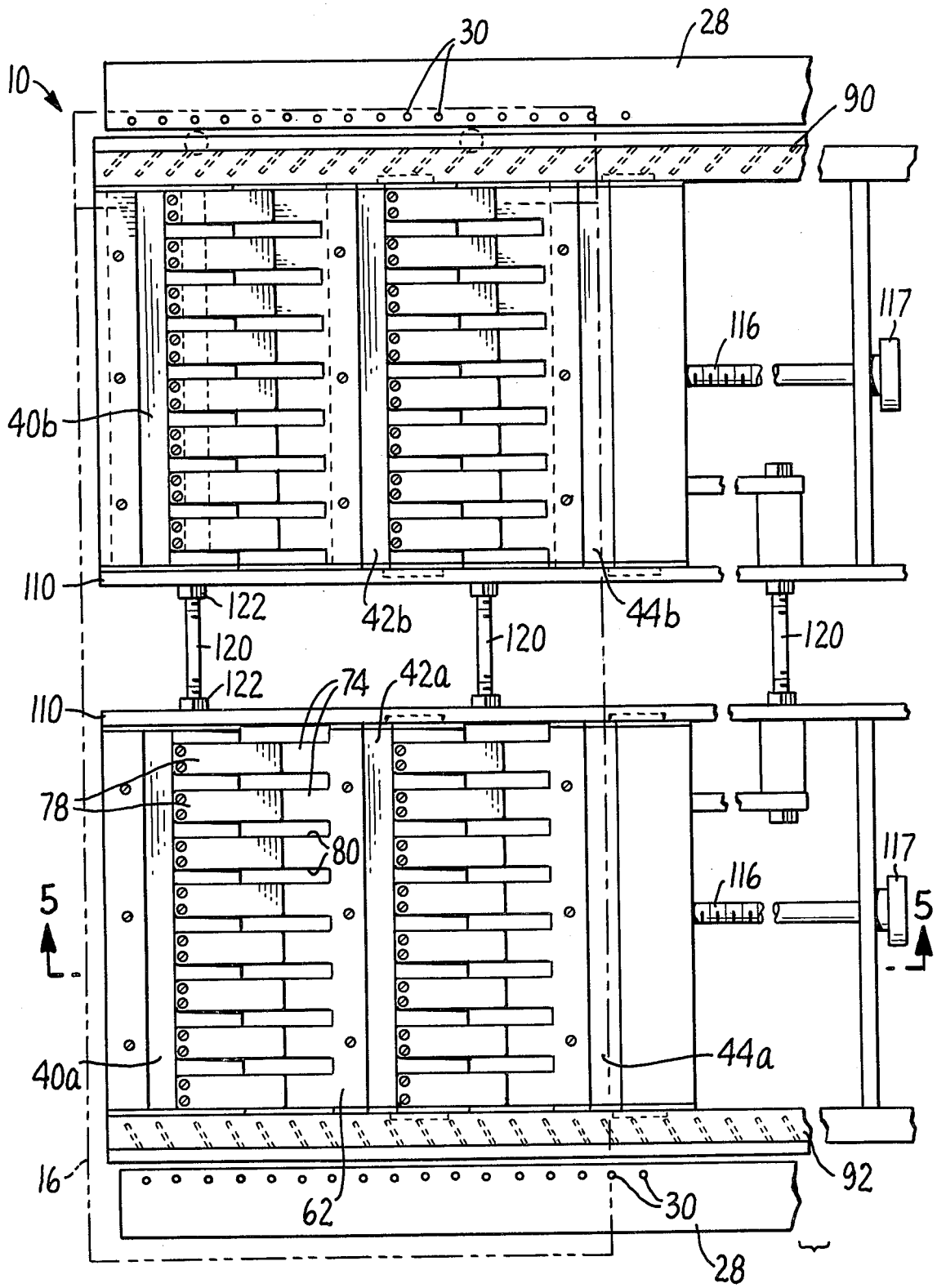
FIG. 4 is a detail plan view of the apparatus of the present invention.
Figure 5:
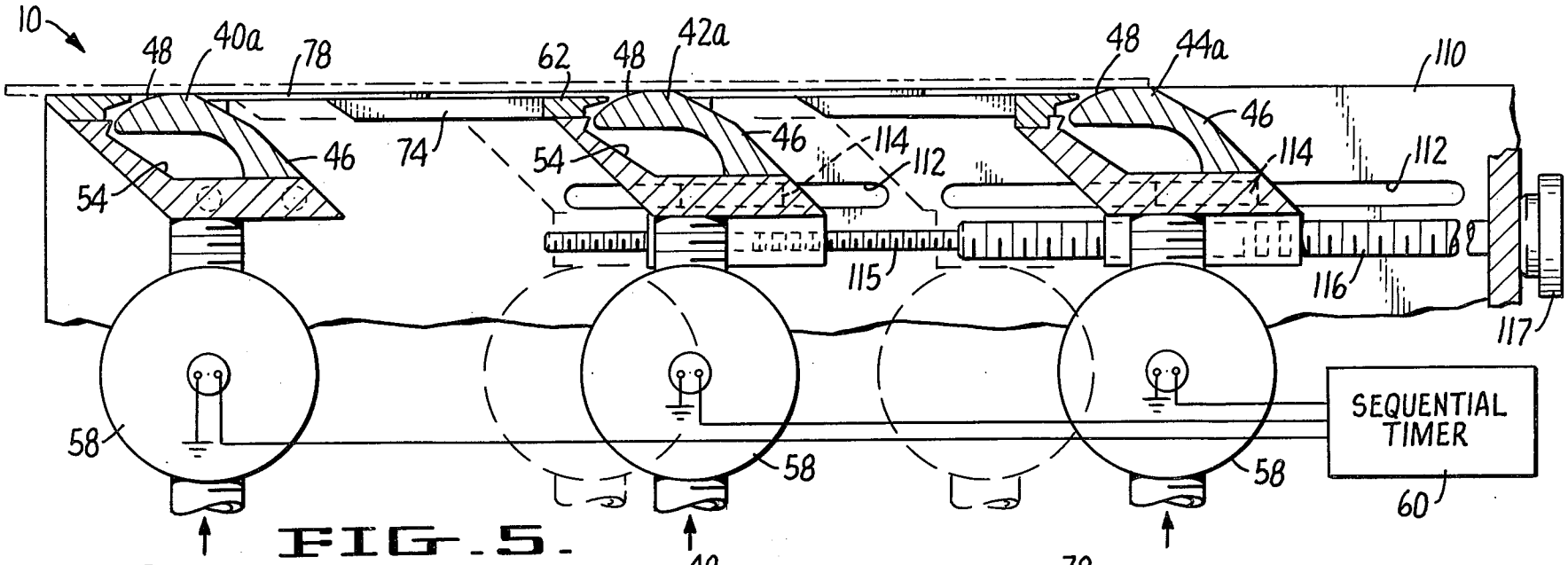
FIG. 5 is a cross sectional view taken along line 5—5 in FIG. 4.

FIG. 1 schematically illustrates apparatus 10 constructed in accordance with the teachings of the present invention disposed between a source 12 of discrete flexible articles and a pickup station generally indicated by reference numeral 14. The articles to be conveyed by the arrangement illustrated in FIGS. 1 and 2 are flexible plastic bread bags 16 of the type, for example, shown in detail in FIG. 3. It will be seen with reference to that figure that bag 16 has a gusset end 17 and spaced apertures 18 formed at a lip end 19 thereof during the manufacturing process. Such apertures are used in the prior art to align a plurality of bags into a precise stacked relationship whereby the bags may be packaged and shipped as a unit to the end user. Stacking alignment of the bags is accomplished by serially placing the bags over bag stacking wickets or spindles and positioning the wickets or spindles in the apertures. FIG. 1 illustrates wickets or spindles 20 accommodating a plurality of bags 16 and awaiting the receipt of more. FIGS. 1 and 2 illustrate a conventional arrangement for serially picking up bread bags and delivering them to the wickets. Such an arrangement comprises spaced pick-up and delivery units 22 and 24 each of which comprises a rotatable hub 26 from which radially project a plurality of arms 28. Arms 28 are hollow and are in selective communication with any suitable vacuum source. Each arm (as may best be seen with reference to FIG. 4) has a plurality of holes 30 formed longitudinally therealong which enable the arms to apply a vacuum to opposed ends of the bags and secure the bags in position relative to the arms while the pick up and delivery units deliver the bags to the wickets with the bag apertures 18 in alignment therewith. The pick-up and delivery units per se are known in the prior art and will not be described further. It should be noted, however, that precise delivery of the bags by the pick-up and delivery units may only be accomplished if the bags are initially put into precise placement relative to the pick-up and delivery units themselves. Such placement becomes progressively more difficult as the speed of delivery of the bags to the pick-up and delivery units increases or the thickness of the film used to manufacture the bags decreases. It is the function of the apparatus 10 of the present invention to provide fast and accurate delivery of the bags to the station occupied by the pick-up and delivery units even when the bags are constructed of film of 1 mil or less. Such bags are delivered to apparatus 10 from a suitable source 12 of the bags which would normally be the downstream end of conventional plastic bread bag forming equipment. Because of its conventional nature such equipment will not be described in detail. Suffice it to say that the finished bags exit from source 12 in discrete serial fashion and are delivered to the upper surface of apparatus 10.

Details of a preferred form of apparatus 10 may best be seen with reference to FIGS. 4–10. Apparatus 10 includes a plurality of Coanda nozzles 40, 42, and 44 disposed in spaced relationship between station 12 and station 14. Each Coanda nozzle is divided into two Coanda nozzle segments, Coanda nozzle 40 comprising segments 40*a* and 40*b*, Coanda nozzle 42 comprising segments 42*a* and 42*b* and Coanda nozzle 44 comprising segments 44*a* and 44*b*. As may perhaps best be seen with reference to FIGS. 5 and 6 each nozzle segment comprises a body member 46 defining a generally smoothly curved Coanda fluid flow attachment surface 48. A first elongated slit 50 is defined by the fluid flow attachment surface and a front wall element 52 of the body member. Slit 50 leads from a plenum 54 formed by the body member. Each plenum 54 is connected to the outlet of a solenoid valve 58 close coupled to each Coanda nozzle. Each valve 58 is in fluid flow communication with a suitable source (not shown) of pressurized air and each valve 58 is operatively connected to a sequential timer device 60 of any suitable type which controls the timing and duration of air supply to the Coanda nozzles in a manner to be more fully described below.

Figure 6:
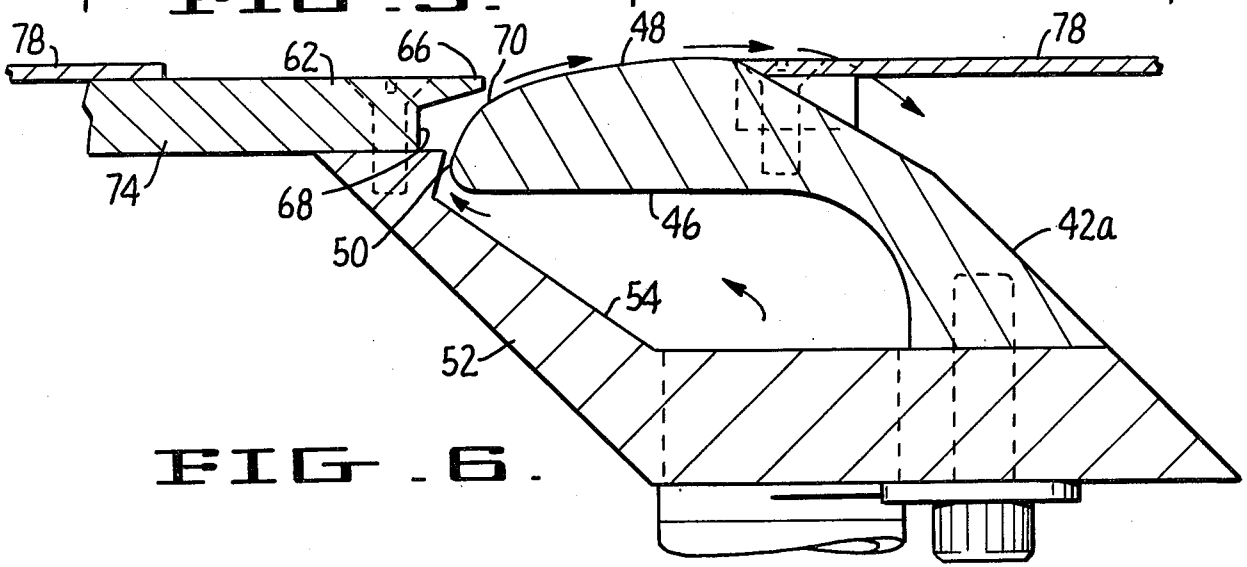
FIG. 6 is an enlarged detailed cross sectional side view showing details of a Coanda nozzle employed in the apparatus in association with article support means.

Disposed at the upstream or leading edge of each Coanda nozzle segment is a cover element defining an open ended cavity with the Coanda fluid flow attachment surface 48 of the nozzle. FIG. 6 shows a representative cover element 62 employed in connection with nozzle segment 42. Cover element 62 is flat at the top thereof and includes an extended lip 66 positioned over elongated slit 50 to define the open ended cavity 68 in fluid flow communication with elongated slit 50 and for receiving pressurized fluid flow therefrom. Extended lip 66 of cover element 62 defines a second elongated slit 70 for receiving a flow of pressurized air after it has passed through elongated slit 50. The width of the second elongated slit 70 is greater than the width of the first elongated slit 50, the width of the first elongated slit preferably being in the range of from about 0.002 inches to about 0.004 inches and the width of the second elongated slit 70 being in the range of from about 0.015 inches to about 0.035 inches.

Pressurized air passing through slit 50 will attach itself to the Coanda fluid flow attachment surface 48 of each nozzle and follow the contours of the surface in the manner shown by the arrows in FIG. 6 so that the pressurized air passes upwardly through slit 70 and flows along the top of each nozzle. In the case of nozzles 40 and 42 the Coanda air flow will then be directed toward article support means positioned downstream therefrom. The article support means comprises a plurality of overlapping finger elements extending between nozzles 40 and 42 and between nozzles 42 and 44. Since the construction of the article support means associated with each of the Coanda nozzle segments is essentially the same, only that in operative association with nozzle segment 40*a* will be described in detail.

The article support means operatively associated with Coanda nozzle segment 40*a* includes a plurality of spaced support fingers 74 integrally formed in connection with cover element 62 and projecting upstream toward nozzle segment 40*a*. Overlapping and in registry with spaced support fingers 74 are a plurality of upper fingers 78 attached by screws or other means to body member 46 of nozzle segment 40*a* at the location where surface 48 turns downward. Since the support fingers and upper fingers are attached only at one end they are slidably engageable with one another in the event the relative positions of nozzle segments 40*a* and nozzle 42*a* are changed. As will be described in greater detail below, such nozzles are relatively adjustable to accommodate bags or other articles of differing widths. The fingers slide relative to one another and will not impede such adjustment. Defined by and between the fingers are spaced elongated apertures 80, the longitudinal dimensions of which may also of course be varied by moving nozzle segments 40*a* and 42*a* relative to one another. The nozzles and their associated article support fingers cooperate to separate gaseous flow induced by the nozzle into a laminar fluid flow component directed along the support surfaces defined by the upper surfaces of the fingers toward the pick-up station 14 to propel the bags therealong and exert a downward pull thereon in a direction substantially normal to the support surfaces and a vented fluid flow component directed downwardly through apertures 80. The gaseous flow passing over each nozzle segment tends to destabilize and become turbulent at the location where surface 48 turns down. The flow becomes thicker due, among other factors, to entrainment of ambient air and if a portion of the air is not vented air disturbances will cause the bag to wrinkle and distort. This venting function is illustrated schematically by the air flow arrows shown in FIG. 6. Generally about ½ to ⅓ of the air flow is vented off, resulting in the moving air cushion flowing along the finger upper surfaces being thinner and more stable.

As will be pointed out later in more detail, air flow through each of the Coanda nozzle segments is turned on and off in rapid fashion during operation of the present apparatus. To rapidly pulse in sequence high air pressures but narrow slits accomodating small quantities of air for each nozzle segment are requirements. This results in a high magnitude suction being found in the vicinity of slit 50 which could distort and foreshorten the bags if placed in too close a proximity thereto. Such suction could also temporarily interrupt forward movement of such bag. The cover element 62 prevents this from occurring by keeping each bag removed from slit 50. Slit 70, however, being substantially wider than slit 50, will not interfere with the flow of pressurized air therefrom despite the fact that such air flow progressively thickens after it leaves slit 50.

The cover element also serves to protect the narrower slit 50 from plugging, a problem that may occur when slip agents or other similar materials are incorporated in or on the bag. It has been found that such an arrangement also creates a more stable thin air layer for applying propulsive forces to the bags by limiting entrainment of ambient air. Because of the nature of the nozzle and the combination thereof with the fingers of the article support means turbulent flows are minimized as is bag flutter.

The present arrangement additionally comprises auxilliary fluid flow generating means for applying opposed air flow forces at the bag ends preventing flutter and other undesired distortions of the unsupported bag ends during conveyance on the article support means and for controlling placement of the bag. The auxilliary fluid flow generating means is in the form of auxilliary Coanda nozzles positioned along the bag flow path under the unsupported bag ends and adapted to pull the bag lengthwise (in the cross machine direction) and straighten the bag as it is propelled along the flow path by the Coanda nozzles 40, 42 and 44. Details of the auxilliary Coanda nozzles are particularly evident with reference to FIGS. 4 and 7–10. An auxilliary Coanda nozzle 90 is disposed along the left side of the flow path as viewed in FIG. 7 and an auxilliary Coanda nozzle 92 generally of like construction is disposed along the right hand side of the flow path as viewed in that figure. Since the auxilliary Coanda nozzles are essentially mirror images of one another, only the details of construction of auxilliary Coanda nozzle 92 will be described, with particular reference being made to FIG. 8. Auxilliary Coanda nozzle 92 includes an elongated element 94 extending virtually along the full length of the path of movement of the bags. A plurality of bores 98 are formed near the top of the elongated element and such spaced bores are in continuous communication with a source of pressurized air through throughbore 100 formed in the elongated element. The generally laterally disposed outlets of bores 98 are adapted to be positioned beneath the free opposed terminal portions of the bags. The bores are preferably canted slightly in the direction of bag movement so as not to impede such movement while exerting a pulling force on the bag ends. A downwardly directed lip 102 projects adjacent to the bore outlets, said lip being continuous and extending along the length of the bag flow path.

Figure 7:
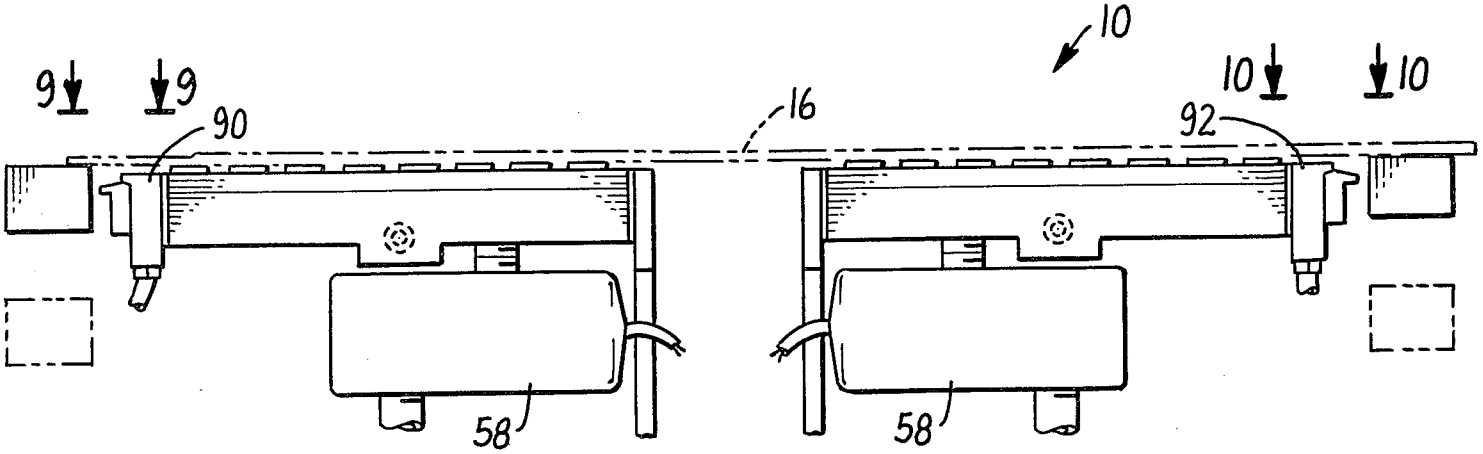
FIG. 7 is an elevational end view of the apparatus.
Figure 10:
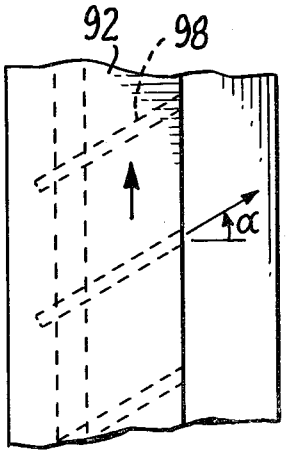
FIG. 10 is a sectional view taken along line 10—10 of FIG. 7.
Figure 9:
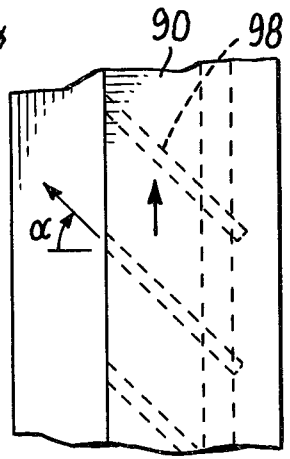
FIG. 9 is a sectional view taken along line 9—9 in FIG. 7.
Figure 8:
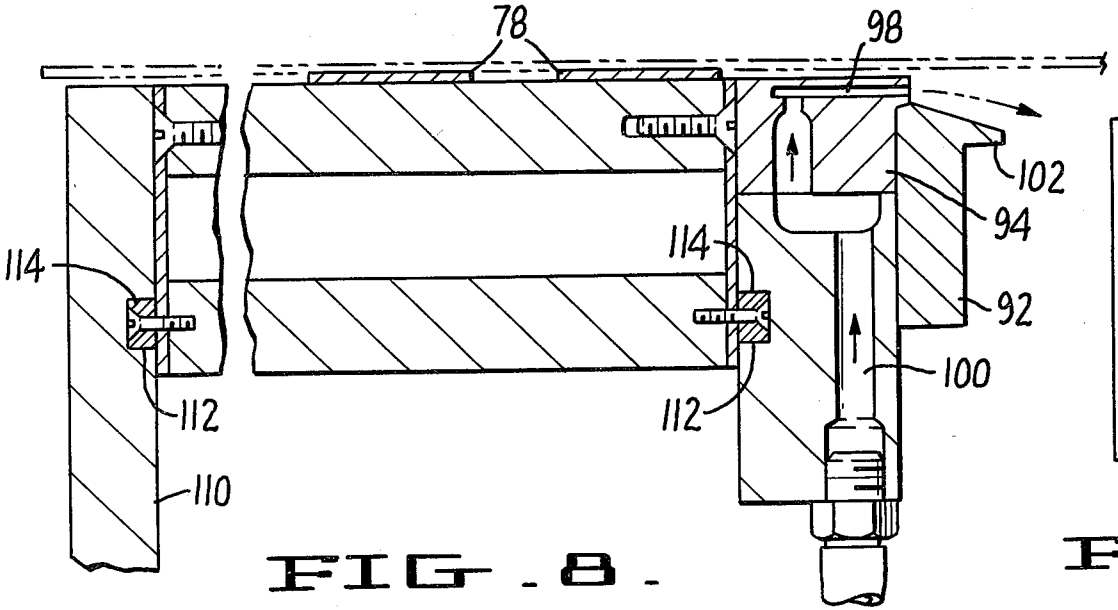
FIG. 8 is an enlarged cross sectional end view of the apparatus showing details of the auxilliary fluid flow generating means.

It should be noted that lip 102 diverges downwardly from the horizontal at an angle thereto. Such lip functions as a Coanda surface diverting the air exiting from bores 98 downwardly. This downward air movement creates suction below the lip and gusset ends. It has been found that failure to so direct the pressurized air will result in undesirable upward curling and other distortion of the bag ends by the air exiting from bores 98. When the apparatus of the present invention is utilized in conjunction with plastic bread bags of the type shown in FIG. 3 it will be appreciated that the bag ends are different. The lip end 19 of the bag wherein apertures 18 are located consists of a single layer while the gusset end 17 of the bag is actually comprised of four overlapping film layers. Thus, each end requires a different controlling and support force. This is accomplished either by different air pressures at auxilliary Coanda nozzles 90 and 92, by having a different nozzle geometry at each bag end, or a combination of both. In a configuration of the type shown in FIGS. 7 and 8 the additional transverse support needed by the heavier gusset end of the bag is, for example, accomplished by canting the bores 98 at different angles or at auxilliary Coanda nozzles 90 and 92 whereby (as may perhaps best be seen in FIGS. 9 and 10) the air streams directed from the bores at the lip end of the bag are directed at a 45° angle to the cross machine direction while the angle of the bores at the gusset end are disposed at only 30°. Some variation in pressures of gas fed to the auxilliary Coanda nozzles may also be employed for this purpose. The objective of the auxilliary Coanda nozzles is to control the stability of the overhanging ends of the bag and also ensure proper cross machine placement of the bag and that the bag travels without skewing, i.e. one end moving faster than the other. The air pressures applied to the auxilliary Coanda nozzles are the primary means for controlling bag placement. By varying the pressures the bags can be "steered." Representative air pressures in a plastic bread bag line were 10–14 psig at the lip end and 4–8 psig at the gusset end. It is to be understood, however, that the factors of nozzle geometry and pressures are, as stated above, dictated by the nature of the article being conveyed. With further reference to the overhanging lip 102 it has been found that an undercut as shown in FIGS. 7 and 8 is essential. Otherwise, the fluid flow along the top of the lip will continue to flow downwardly and pull down the bag ends to an undesirable degree.

While the auxilliary Coanda nozzles 90 and 92 are operated under continuous flow conditions, such is not the case for Coanda nozzles 40, 42 and 44. Coanda nozzles 40, 42 and 44 are operated in timed sequence so that the bags transported by the apparatus are not distorted during conveyance thereof. It will be appreciated, of course, that transport of the bags or other articles on apparatus 10 must be coordinated with the rotation of vacuum arms 28 at pick-up station 14. The rotating hub supporting arms 28 is positioned below the bag support surface of apparatus 10 as defined by the fingers 78. Consequently, as each arm is rotated into position along the sides of apparatus 10 the outwardly extended ends of the bag will be contacted by the arms and secured thereto by the vacuum in the arms. Assuming that a bag has already been positioned on top of apparatus 10 and transported thereby Coanda nozzle 40 is off and the bag on apparatus 10 will first be contacted by the arms at the location of nozzle 40. Nozzles 42 and 44 are also off at this time. Immediately upon engagement of the bag at the vicinity of Coanda nozzle 40 by the spaced pick-up arms 28 and lifting of the bag thereby, pressurized air will be supplied to the segments of Coanda nozzle 40 so that another bag exiting from source 12 will be picked up thereby and movement along apparatus 10 initiated. When the leading edge of the bag approaches nozzle 42, nozzle 42 is actuated and nozzle 40 is again turned off. In like manner when the leading edge of the bag is close to Coanda nozzle 44, Coanda nozzle 42 is deactivated. In other words, the nozzles are sequentially turned on and off as the bag moves along the support fingers of the apparatus. Any suitable timer mechanism may be utilized to accomplish this objective. In an actual embodiment constructed in accordance with the teachings of the present invention three cams on a drive mechanism were used in combination with proximity switches to control nozzle flow.

In an apparatus constructed in accordance with the teachings of the present invention air flow to each pair of Coanda nozzle segments was controlled by a single pressure regulator. Air lines from the regulator to the corresponding pair of solenoids was constructed of identical length to minimize possible nozzle cavity pressure differences. The nozzle slits were set very accurately so that they were equal in each segment of each nozzle. In fact, all nozzle segments had the same slit characteristics and slit 50 was in the range of 0.002–0.004 inches for each. The pressures measured at the regulators with respect to each nozzle were as follows:

Nozzle 40—40–46 psig
Nozzle 42—30–38 psig
Nozzle 44—20–24 psig

These figures include pressure drops across the solenoids and supply lines to them. It should be noted that the initial or pick-up nozzle 40 had the highest pressure since a greater force is required for initial bag pick-up.

As stated above, it is considered desirable to make apparatus 10 adjustable so that it may accommodate various sized bags or other articles. Each of the segments of Coanda nozzles 40, 42 and 44 and its associated valve 48 may be selectively movably positioned relative to the other components of apparatus 10 in the direction of movement of the bags. The frames 110 within which each Coanda nozzle segment is positioned have elongated slots 112 formed in the inner sides thereof to accomodate projections or keys 114 connected to each segment body. Interconnected threaded rods 115 and 116 threadedly secured to the segments of nozzles 42 and 44 may be turned by handle 117 to move the segments. Rod 115 has half the pitch of rod 116 so that the segments of nozzle 42 will move half the distance the segments of nozzle 44 are moved, thus ensuring that nozzle 42 is substantially midway between nozzles 40 and 44. It is also felt desirable to provide some means whereby the segments of each Coanda nozzle may be moved toward and away from one another to accomodate bags or other articles of various lengths. This may be accomplished by mounting frames 110 on threaded connectors 120 whereby the frames 110 can be slid to the desired position and secured into place by means of lock nuts 122 or other desired mechanism to maintain the frames 110 and thus the Coanda nozzle segments at the desired distances from one another.

I claim:

1. Apparatus for serially conveying discrete flexible articles along a flow path between a first station and a second station comprising, in combination:

a plurality of Coanda nozzles positioned along said flow path, said nozzles including a body member defining a generally smoothly curved Coanda fluid flow attachment surface, a slit defining element defining a first elongated slit with the Coanda fluid flow attachment surface, said first elongated slit being substantially straight and extending in a direction generally perpendicular to said flow path, and at least one of said nozzles including a cover element spaced from said first elongated slit and defining a cover surface directed toward said Coanda fluid flow attachment surface and for maintaining a predetermined distance between said articles and said first elongated slit; and article support means extending between at least some of said Coanda nozzles defining spaced generally flat support surfaces leading from said Coanda fluid flow attachment surfaces toward cover surfaces of adjacent Coanda nozzles and additionally defining a plurality of apertures between said support surfaces and in communication therewith and with said Coanda fluid flow attachment surfaces, said nozzles and said article support means cooperable to separate air flow induced by at least one of said nozzles into a laminar fluid flow component directed along said support surfaces toward said second station to propel said articles therealong and exert a suction force thereon in a direction substantially normal to said flow path and a vented fluid flow component directed through said apertures to prevent the build-up of air disturbances that would otherwise be imparted to the articles during conveyance thereof.

2. The apparatus of claim 1 wherein said article support means comprises a plurality of finger elements extending from at least some of said Coanda nozzles and at least partially overlapping with finger elements extending from adjacent Coanda nozzles and defining elongated apertures therebetween.

3. The apparatus of claim 1 wherein said Coanda nozzle is comprised of a plurality of Coanda nozzle segments and additionally comprising means for adjusting the distance between said Coanda nozzle segments in a direction laterally disposed relative to said flow path.

4. The apparatus of claim 1 wherein said cover element defines a cavity in communication with said first elongated slit and for receiving pressurized fluid flow therefrom, said cover element and said body member defining a second elongated slit for receiving a flow of pressurized fluid after it has passed through said first elongated slit and said cavity, the width of said second elongated slit being greater than the width of said first elongated slit so that the cover element will not interfere with pressurized fluid flow from said first elongated slit.

5. The apparatus of claim 4 wherein the width of said first elongated slit is in the range of from about 0.002 inches to about 0.004 inches and the width of said second elongated slit is in the range of from about 0.015 to about 0.035 inches.

6. The apparatus of claim 1 additionally comprising auxilliary fluid flow generating means including a plurality of auxilliary Coanda nozzles with at least one auxilliary Coanda nozzle positioned along each outer edge of said flow path for exerting pulling forces on said articles during conveyance thereof in generally opposed directions laterally disposed relative to said flow path, said auxilliary Coanda nozzles being adapted to be in registry with opposed terminal portions of said flexible articles, and each said auxilliary nozzle comprising pressurized fluid outlet defining means and flow attachment surface defining means, the flow attachment surface terminating at a projecting element spaced from said pressurized fluid outlet.

7. The apparatus of claim 6 wherein each of said pressurized fluid outlet is canted at a predetermined angle in the direction of said flow path.

8. The apparatus of claim 7 wherein the pressurized fluid outlets comprise a plurality of bores, the bores of one auxilliary nozzle being canted at a different angle along one edge of the flow path than the bores at the other edge thereof.

9. The apparatus of claim 8 wherein the differential angle between auxilliary nozzle bores along the two flow path edges is in the order of about 15 degrees.

10. The apparatus of claim 1 wherein at least some of said Coanda nozzles define a fluid flow attachment surface having a generally curved surface portion leading to said support surface and a second surface portion leading away from said support surface and directing the vented fluid flow component through said apertures.

11. A method for serially conveying discrete flexible articles along a flow path defined by support surfaces between a first station and a second station comprising the steps of:

initiating a gaseous flow at a plurality of predetermined locations along said flow path by flowing pressurized gas through substantially straight elongated first slits disposed generally perpendicular to said flow path and spaced therealong;

directing a laminar portion of each of said gaseous flows along spaced article support surfaces extending between said plurality of predetermined locations through utilization of the Coanda effect toward said second station;

substantially simultaneously venting turbulent portions of said gaseous flows between said spaced article support surfaces in a direction substantially deviating from the direction of movement of said laminar portion through utilization of the Coanda effect;

placing said articles in sequential engagement with said gaseous flows;

utilizing said gaseous flow laminar portions to propel said articles toward said second station along said spaced article support surfaces and exert a suction on said articles in a direction substantially normal to the direction of said flow path; and during conveyance of said articles maintaining said articles a predetermined distance from said first slits by interposing a physical barrier between said articles and first slits, said barriers defining second slits, through which said pressurized gas flow passes after flowing through said first slits.

12. The method of claim 11 comprising the additional step of exerting pulling forces on said articles in generally opposed directions laterally disposed relative to said flow path during movement of said articles along said flow path by directing gaseous flows against the ends of said articles laterally relative to the flow path and at predetermined angles in the direction of the flow path.

13. The method of claim 11 comprising the additional steps of initiating the gaseous flows at said plurality of predetermined locations in timed sequence responsive to the location of the leading edge of each said article being conveyed and serially terminating each of said flows responsive to initiating of said flow at an adjacent downstream location.

14. A method for serially conveying discrete flexible articles along a flow path between a first station and a second station comprising the steps of:

at a first location adjacent to said first station consecutively flowing pressurized gas through a first set of spaced substantially straignt elongated first and second slits disposed generally perpendicular to said flow path and changing the direction of said pressurized gas flow by attaching said gas to a Coanda fluid flow attachment surface leading toward said second station;

placing a discrete flexible article into close proximity to said pressurized gas flow after said gas has attached to said Coanda fluid flow attachment surface and flowed through said spaced first and second slits whereby said discrete flexible article is entrained thereby and propelled toward said second section;

at a second location between said first location and said second station consecutively flowing a second flow of pressurized gas through a second set of spaced substantially straight elongated first and second slits disposed generally perpendicular to said flow path and changing the direction of said second pressurized gas flow by attaching said gas to a second Coanda fluid flow attachment surface leading toward said second station;

placing said discrete flexible article into close proximity to said second pressurized gas flow after said gas has attached to said second Coanda fluid flow attachment surface and flowed through said spaced first and second slits whereby said discrete flexible article is entrained thereby and propelled toward said second station;

during conveyance of said article maintaining said article a predetermined distance from said first slits by interposing a physical barrier between said article and first slits; and terminating gas flow at said first location after said discrete flexible article has been entrained at said second location.

15. In an apparatus for serially conveying discrete flexible articles between a first station and a second station along a predetermined flow path, the improvement comprising:

at least one Coanda nozzle disposed between said first and second stations, said Coanda nozzle defining a first elongated substantially straight slit extending in a direction generally perpendicular to said flow path and a Coanda fluid flow attachment surface extending from said elongated slit, said surface comprising a generally curved surface portion and a second surface portion connected to said generally curved surface portion and deviating therefrom;

a plurality of spaced finger elements extending from said fluid flow attachment surface at the juncture of said surface portions, said finger elements defining support surfaces and apertures therebetween, said nozzle cooperable with said finger elements to separte air flow from said nozzle into a laminar flow component directed along said support surfaces toward said second station to propel said articles therealong and exert a suction force thereon in a direction substantially normal to the path of movement of said articles between said stations and a vented fluid flow component directed through said apertures to prevent build-up of air disturbances that would otherwise be imparted to the articles during conveyance thereof; and a cover element defining a cavity in communication with said first elongated slit and for receiving pressurized air flow therefrom, said cover element defining a second elongated slit with said nozzle for receiving a flow of pressurized air after it has passed through said first elongated slit and said cavity, said second elongated slit having a width greater than the first elongated slit, said cover element comprising a physical barrier for maintaining said articles a predetermined distance from said first elongated slit.

* * * * *